United States Patent [19]

Wilson

[11] 4,103,371

[45] Aug. 1, 1978

[54] TOILET SEAT LIFT

[76] Inventor: Lester J. Wilson, R.D. 3, Cambridge Springs, Pa. 16403

[21] Appl. No.: 750,424

[22] Filed: Dec. 14, 1976

[51] Int. Cl.[2] ..... A47K 13/10; E05F 13/00; F16J 3/06

[52] U.S. Cl. ..... 4/251; 49/265; 60/533; 92/44

[58] Field of Search ..... 4/1, 108, 240, 248, 4/249, 251; 60/533; 92/44, 51, 84; 49/265

[56] References Cited

U.S. PATENT DOCUMENTS

| | | | |
|---|---|---|---|
| 2,842,779 | 7/1958 | Zulkoski | 4/251 |
| 2,849,728 | 9/1958 | Gyllenberg | 4/251 |

FOREIGN PATENT DOCUMENTS

| | | | |
|---|---|---|---|
| 67,372 | 7/1948 | Denmark | 4/251 |
| 1,229,853 | 3/1960 | France | 60/533 |
| 82,769 | 10/1919 | Switzerland | 4/251 |

*Primary Examiner*—Houston S. Bell, Jr.
*Assistant Examiner*—Stuart S. Levy
*Attorney, Agent, or Firm*—Charles L. Lovercheck

[57] ABSTRACT

The application discloses a foot actuated air or liquid dispensing means connected to a cylinder and piston rod for lifting the seat, so that the user will not have to soil his hands lifting the seat.

1 Claim, 3 Drawing Figures

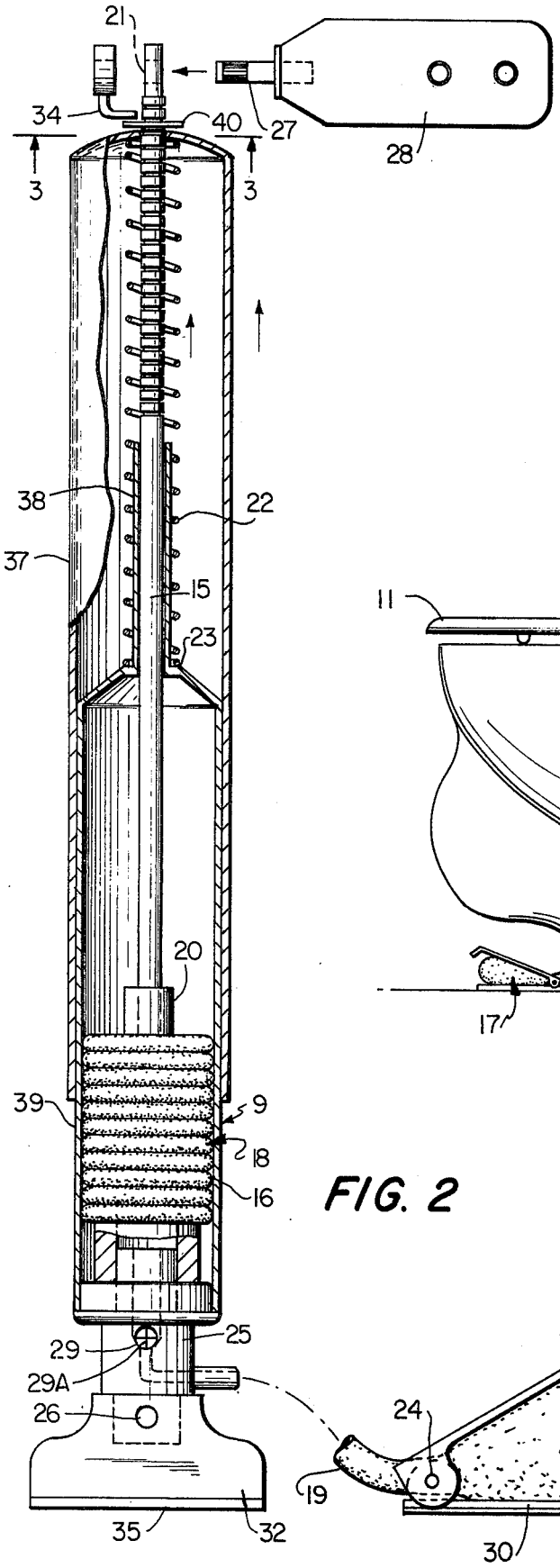
FIG. 2
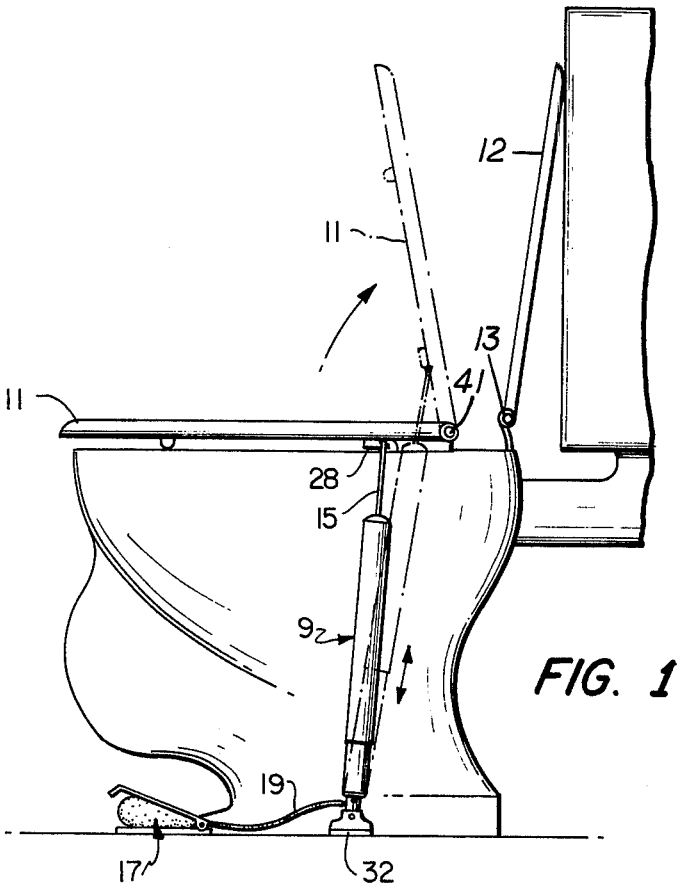
FIG. 1
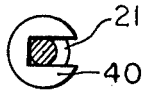
FIG. 3
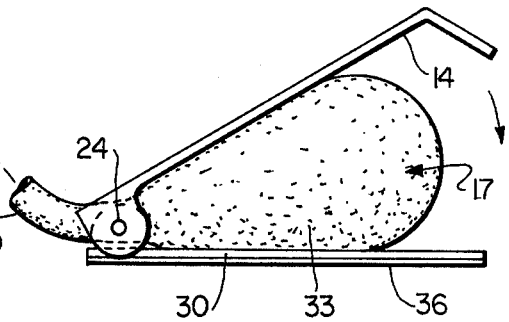

TOILET SEAT LIFT

GENERAL DESCRIPTION OF THE INVENTION

In private homes or public restrooms, toilet seats often become contaminated so that patrons hesitate to touch them with their hands. I have devised a simple, efficient manner of lifting a toilet seat to eliminate this disagreeable duty of hand contact.

The general configuration of a toilet seat shown in U.S. Pat. No. 2,842,779, wherein an air dispensing member connects directly to a lifting device for a toilet seat, I have devised a simple, more efficient device for carrying out this function.

OBJECTS OF THE INVENTION

It is an object of the invention to provide an improved toilet seat lifting device.

Another object of the invention is to provide a toilet seat lifting device that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a side view of a toilet seat and lifting device according to the invention.

FIG. 2 is a view partly in cross section of the air cylinder and parts used for lifting the toilet seat.

FIG. 3 is a cross-sectional view taken on line 3—3 of FIG. 2 showing the C-shaped washer.

DETAILED DESCRIPTION OF THE DRAWINGS

Now, with more particular reference to the drawings, the toilet seat lifting device 9, according to the invention, is generally shown in FIG. 1. A toilet 10 familiar to those skilled in the art, having a seat 11 and a cover 12, and hinges 13 and 41 connecting the seat 11 and the cover 12 to the toilet 10 in a conventional manner. As shown in greater detail in FIG. 2, the air or liquid dispensing device 17 has a base 30 which has a layer of non-skid material 36 applied to its floor engaging side. The non-skid material 36 may be rubber or other suitable material. The air or liquid dispensing device 17 is adapted to be engaged by a person's foot, thus admitting air or liquid through the tube 19 and the connecting member 25 into the bellows 18. The air or liquid dispensing device 17 may be any of the usual types familiar to those skilled in the art, for example, an air syringe as indicated at 33. The air or liquid dispensing device 17 has a lever member 14 pivoted at pivot 24 on the base 30. The pivot 24 may be a living hinge in an all plastic construction. When the lever member 14 is engaged by a person's foot pressing downward, the lever member 14 squeezes the syringe 33 urging air or liquid through the tube 19 past the check valve 29 in the connecting member 25 and into the bellows 18. The check valve 29 can be a ball type valve which will readily permit flow into the bellows 18 to raise the seat 11. The surface of the ball is scratched at 29A or notched sufficiently to permit leakage but the flow back toward the syringe 33 is restrained. Thus, the seat 11 will slowly descend to its lowered position when the foot pressure is released from the lever 14. The bellows 18 is comprised of a plurality of convolutions 16. The bellows 18 is connected at its lower end to the connecting member 25 by the adapter 31. The connecting member 25 has a female member that fits into base 35. The base 32 under the toilet seat lifting device 9 has a layer of non-skid material 35 applied to its floor engaging side. The non-skid material 35 may be rubber or other suitable material.

The bellows 18 is expanded by the air or liquid forced into it by the air or liquid dispensing device 17. The bellows 18 expands upwardly inside the cover 39. At the upper end of the bellows 18 is the female molded insert 20 which receives the lower end of the rod 15. The rod 15 extends from the insert 20 at the upper end of the bellows 18 to the seat plate 28 which attaches to the toilet seat 11 by means of screws or other suitable means. The spring 22 is disposed around the upper end 38 of the bellows cover 39. The lower end of the spring 22 rests on the shoulder 23 of the bellows cover 39 and the upper end rests against the adjustable spring clip 40. The spring 22 counterbalances the weight of the toilet seat so that a minimum effort of air or liquid in the bellows 18 is necessary to lift the seat. The spring clip 40 is adjustable on the rod 15 to adjust the spring 22 to the proper tension for the weight of the toilet seat. The upper end of the rod 15 has the eyelet 21 which receives the pin 27. The pin 27 is received at its other end by the plate 28. The plate 28 is attached in spaced relation from the hinges 13 to the seat 11. The pin 27 has the stop 34 attached to it opposite the seat plate 28 with the rod 15 therebetween. The stop 34 is rotated by the seat plate 28 as the lifting device 9 raises the seat 11. The stop 34 is adjustable and at its optimum setting it will engage the rod 15 and prevent the further lifting of the seat 11 when it has been lifted to a point where it is almost but not quite, vertical. From this almost vertical raised position, gravity will return the seat 11 to the lowered position when the pressure is released from the lever member 14. The seat 11 will return to its lowered position slowly because of the check valve 29.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a toilet having a seat 11 and a cover 12, hinge means 41 connecting said seat 11 to said toilet 1, bulb means 17 to be engaged by a person's foot for operating said toilet seat 11, a rod 15 pivotally connected to said seat in a position spaced from said hinge means, a hollow cylinder supported relative to said toilet at one end, a bellows-like member 18 in said hollow cylinder 9 having said rod 15 connected to the upper end thereof 20 and adapted to be expanded by fluid from said bulb means 17, said bulb means 17 comprising a hollow expandable bulb connected to said bellows-like member for forcing air into said bellows-like member whereby said rod swings said seat to lifted position, a C-shaped washer on an end of said rod, spaced grooves in said rod receiving said washer, a cylindrical dust cover telescopically received on said cylinder, a helical spring supported on said rod, one end of said helical spring resting on said cylinder and the other end of said spring supported on said dust cover urging said rod and said seat upward to counterbalance said seat, said rod having longitudinally-spaced grooves, said C-shaped washer being selectively received in said longitudinally-spaced grooves in said rod whereby said seat is counter-balanced to swing upwardly, and said spring extending through the inside of said dust cover and engaging the top of said dust cover for urging said rod upwardly.

* * * * *